United States Patent [19]

Borsenberger

[11] Patent Number: 4,711,831

[45] Date of Patent: Dec. 8, 1987

[54] SPECTRAL SENSITIZATION OF AMORPHOUS SILICON PHOTOCONDUCTIVE ELEMENTS WITH PHTHALOCYANINE AND ARYLAMINE LAYERS

[75] Inventor: Paul M. Borsenberger, Hilton, N.Y.

[73] Assignee: Eastman Kodak Company, Rochester, N.Y.

[21] Appl. No.: 7,030

[22] Filed: Jan. 27, 1987

[51] Int. Cl.[4] ..... G03G 5/09

[52] U.S. Cl. ..... 430/95; 430/59; 430/66

[58] Field of Search ..... 430/95, 59, 66

[56] References Cited

U.S. PATENT DOCUMENTS

| | | | |
|---|---|---|---|
| 4,349,617 | 9/1982 | Kawashiri et al. | 430/59 |
| 4,461,819 | 7/1984 | Nakagawa et al. | 430/59 |
| 4,471,039 | 9/1984 | Borsenberger et al. | 430/58 |
| 4,491,626 | 1/1985 | Kawamura et al. | 430/69 |
| 4,557,989 | 12/1985 | Branston et al. | 430/59 |

FOREIGN PATENT DOCUMENTS 2095416 9/1982 United Kingdom .

*Primary Examiner*—J. David Welsh
*Attorney, Agent, or Firm*—Alfred P. Lorenzo

[57] ABSTRACT

Multi-layer photoconductive elements comprising one or more layers of hydrogenated amorphous silicon are provided with sensitizing and supersensitizing layers which function to alter the spectral sensitivity of the element and thereby enhance its usefulness in such applications as photovoltaic devices, thin film electronic devices, and electrophotographic photoreceptors. The sensitizing layer contains a phthalocyanine which serves as a spectral sensitizing agent and the supersensitizing layer contains an arylamine which serves as a chemical sensitizing agent. The sensitizing and supersensitizing layers serve by their conjoint action to inject charge into the hydrogenated amorphous silicon layer in response to photogeneration within the sensitizing layer that is activated by radiation to which the hydrogenated amorphous silicon layer exhibits a lower degree of sensitivity.

14 Claims, 4 Drawing Figures

SPECTRAL SENSITIZATION OF AMORPHOUS SILICON PHOTOCONDUCTIVE ELEMENTS WITH PHTHALOCYANINE AND ARYLAMINE LAYERS

FIELD OF THE INVENTION

This invention relates in general to multi-layer photoconductive elements and in particular to multi-layer photoconductive elements comprising one or more layers of hydrogenated amorphous silicon. More specifically, this invention relates to multi-layer photoconductive amorphous silicon elements containing sensitizing and supersensitizing layers which function to alter the spectral sensitivity of the element, and thereby enhance its usefulness in such applications as photovoltaic devices, thin film electronic devices and electrophotographic photoreceptors.

BACKGROUND OF THE INVENTION

The preparation of thin films of amorphous silicon, hereinafter referred to as α-Si, by the glow discharge decomposition of silane gas, $SiH_4$, has been known for a number of years. (See, for example, R. C. Chittick, J. H. Alexander and H. F. Sterling, J. Electrochem. Soc., 116, 77, 1969 and R. C. Chittick, J. N-Cryst. Solids, 3, 255, 1970). It is also known that the degree of conductivity and conductivity type of these thin films can be varied by doping with suitable elements in a manner analogous to that observed in crystalline semiconductors. (See, for example, W. E. Spear and P. G. LeComber, Solid State Commun., 17, 1193, 1975). Furthermore, it is widely recognized that the presence of atomic hydrogen plays a major role in the electrical and optical properties of these materials (see, for example, M. H. Brodsky, Thin Solid Films, 50, 57, 1978) and thus there is widespread current interest in the properties and uses of thin films of so-called "hydrogenated amorphous silicon", hereinafter referred to as α-Si(H).

Hydrogenated amorphous silicon, α-Si(H), is of increasing technological interest for applications such as photovoltaic devices, thin film electronic devices, and electrophotographic photoreceptors. The technological interest is largely due to a combination of the electrical and mechanical properties plus the fact that α-Si(H) can be readily fabricated into low cost, large area structures. The electrical properties are such that this material can be fabricated with either n-type or p-type conductivity over a range of some eight orders of magnitude. When prepared under optimum conditions, the photogeneration efficiency is near unity.

The field of electrophotography is one in which there is especially extensive current interest in the utilization of α-Si(H). To date, the art has disclosed a wide variety of photoconductive insulating elements, comprising thin films of intrinsic and/or doped α-Si(H), which are adapted for use in electrophotographic processes. (As used herein, the term "a doped α-Si(H) layer" refers to a layer of hydrogenated amorphous silicon that has been doped with one or more elements to a degree sufficient to render it either n-type or p-type). Included among the many patents describing photoconductive insulating elements containing layers of intrinsic and/or doped α-Si(H) are the following:

Kempter, U.S. Pat. No. 4,225,222, issued Sept. 30, 1980.
Hirai et al, U.S. Pat. No. 4,265,991, issued May 5, 1981.

Fukuda et al, U.S. Pat. No. 4,359,512, issued Nov. 16, 1982.
Shimizu et al, U.S. Pat. No. 4,359,514, issued Nov. 16, 1982.
Ishioka et al, U.S. Pat. No. 4,377,628, issued Mar. 22, 1983.
Shimizu et al, U.S. Pat. No. 4,403,026, issued Sept. 6, 1983.
Shimizu et al, U.S. Pat. No. 4,409,308, issued Oct. 11, 1983.
Kanbe et al, U.S. Pat. No. 4,443,529, issued Apr. 17, 1984.
Nakagawa et al, U.S. Pat. No. 4,461,819, issued July 24, 1984.

Photoconductive elements that are useful in electrophotography comprise a conducting support bearing a layer of a photoconductive material which is insulating in the dark but which becomes conductive upon exposure to radiation. A common technique for forming images with such elements is to uniformly electrostatically charge the surface of the element and then imagewise expose it to radiation. In areas where the photoconductive layer is irradiated, mobile charge carriers are generated which migrate to the surface of the element and there dissipate the surface charge. This leaves behind a charge pattern in non-irradiated static image. This latent electrostatic image can then be developed, either on the surface on which it is formed, or on another surface to which it has been transferred, by application of a developer which contains electroscopic marking particles. These particles are selectively attracted to, and deposit in, the charged areas or are repelled by the charged areas and selectively deposited in the uncharged areas. The pattern of marking particles can be fixed to the surface on which they are deposited or they can be transferred to another surface and fixed there.

For electrophotographic use, photoconductive elements can comprise a single active layer, containing the photoconductive material, or they can comprise multiple active layers. Elements with multiple active layers (sometimes referred to as multi-active elements) have at least one charge-generating layer and at least one charge-transport layer. The charge-generating layer responds to radiation by generating mobile charge carriers and the charge-transport layer facilitates the migration of the charge carriers to the surface of the element, where they dissipate the uniform electrostatic charge in exposed areas and form the electrostatic latent image.

Photovoltaic devices represent another very important area of technology in which there is great interest in the use of α-Si(H). These are devices which are useful for converting solar energy into electrical energy. In the past, the materials chiefly used in these devices have been inorganic crystalline semiconductors. However, such devices have proven to be very expensive to construct, due to the processing techniques necessary to fabricate the semiconductor layer.

A fundamental limitation of α-Si(H) is that the bandgap is approximately 1.70 eV. As a result, α-Si(H) shows very little photoconductivity in the near infrared region of the spectrum. This is a serious limitation for photovoltaic devices, since a significant fraction of the solar spectrum is in the near infrared region. For electrophotographic applications, the increasing interest in exposures derived from electronic light emitting devices, such as diode lasers or light emitting diodes, has placed similar requirements on infrared sensitivity. For these reasons, there is great interest in extending the action spectrum of α-Si(H) to longer wavelengths.

Unlike the chalcogenide glasses, α-Si(H) does not show a nonphotoconducting absorption edge. The action spectrum is symbatic with the absorption spectrum. As a result, the decrease in sensitivity with increasing wavelength is due to a decrease in absorption and not a decrease in the intrinsic photogeneration efficiency. Since the long wavelength absorption edge of α-Si(H) can be determined by structural disorder, there have been several attempts to extend the absorption edge by controlling the degree of disorder. In such a manner, the long wavelength edge of the action spectrum can be extended to 740 to 760 nm. This technique, however, requires a significant increase in the density of gap states which, in turn, sharply reduces the carrier lifetimes. In addition, the long wavelength shift is relatively small. For these reasons, this technique is of little practical significance.

An alternative method of spectral sensitization involves the formation of Si-containing alloys. By combining Si with other elements, it is possible to form alloys with lower bandgaps. Two such alloys have been described in the literature, one involving Sn (see, for example, I. Shimizu, *Proceedings of the 11th International Conference on Amorphous and Liquid Semiconductors*, Rome, Italy, 1985) and one based on Ge (see, for example, G. Nakamura et al, Jap. J. Appl. Phys. 20, 20-1, 291, 1981). Alloys of either Ge or Sn and Si can be prepared with the desired absorption spectra. In the case of the Sn alloys, the carrier lifetimes are extremely short. Further, these materials show no measurable photoconductivity and cannot be doped to either n- or p-type conductivity. Alloys of Ge and Si are photosensitive, however, these materials show other fundamental disadvantages. For example:

(1) Relative to α-Si(H), the photogeneration efficiencies are extremely low. (For α-Ge(H) the photogeneration efficiencies are typically in the range of $10^{-4}$.)
(2) The dark conductivity increases sharply with the incorporation of Ge.
(3) Alloys containing Ge are prepared from gaseous $GeH_4$ which is extremely toxic.
(4) Due to the preferential attachment of H to Si, alloys of Si and Ge tend to be chemically inhomogeneous with respect to H.

In view of these considerations, it is apparent that alloy formation is a sensitization technique with several fundamental limitations, particularly with respect to electrophotography.

It is toward the objective of providing an effective means for spectral sensitization of amorphous silicon photoconductive elements and especially of achieving a significant bathochromic shift, that is a shift to a region of longer wavelength, in the spectral sensitivity of such elements, that the present invention is directed.

SUMMARY OF THE INVENTION

In accordance with this invention, a multi-layer photoconductive element having a high degree of photosensitivity in both the visible and near infrared regions of the spectrum is comprised of:

a support;
a layer of hydrogenated amorphous silicon;
a sensitizing layer comprising a phthalocyanine that serves as a spectral sensitizing agent;
and a supersensitizing layer comprising an arylamine that serves as a chemical sensitizing agent.

The combination of a sensitizing layer, which contains a phthalocyanine that serves as a spectral sensitizing agent, and a supersensitizing layer, which contains an arylamine that serves as a chemical sensitizing agent, provides a unique and highly advantageous solution to the problem of shifting the spectral sensitivity of an α-Si(H) element in a desired manner. In accordance with the invention, the element contains one or more α-Si(H) layers, which may be doped or undoped as desired, and the supersensitizing layer is interposed between and in contact with both an α-Si(H) layer and the sensitizing layer. By the conjoint action of the sensitizing and supersensitizing layers, charge is injected into the α-Si(H) layer in response to photogeneration that is activated by radiation to which the sensitizing layer exhibits the necessary degree of sensitivity. Since the sensitizing layer can be adapted to provide a high degree of sensitivity in a region of the spectrum in which the α-Si(H) layer exhibits no sensitivity, or a much lower level of sensitivity, the invention makes it readily feasible to achieve the desired bathochromic shift to the near infrared. Thus, the invention provides a unique multi-layer photoconductive element which combines a high degree of sensitivity in both the visible and near infrared regions of the spectrum with the many advantageous properties that characterize amorphous silicon elements, such as low cost, ease of fabrication, and excellent mechanical and electrical characteristics.

DESCRIPTION OF THE PREFERRED EMBODIMENTS

Figure 1:
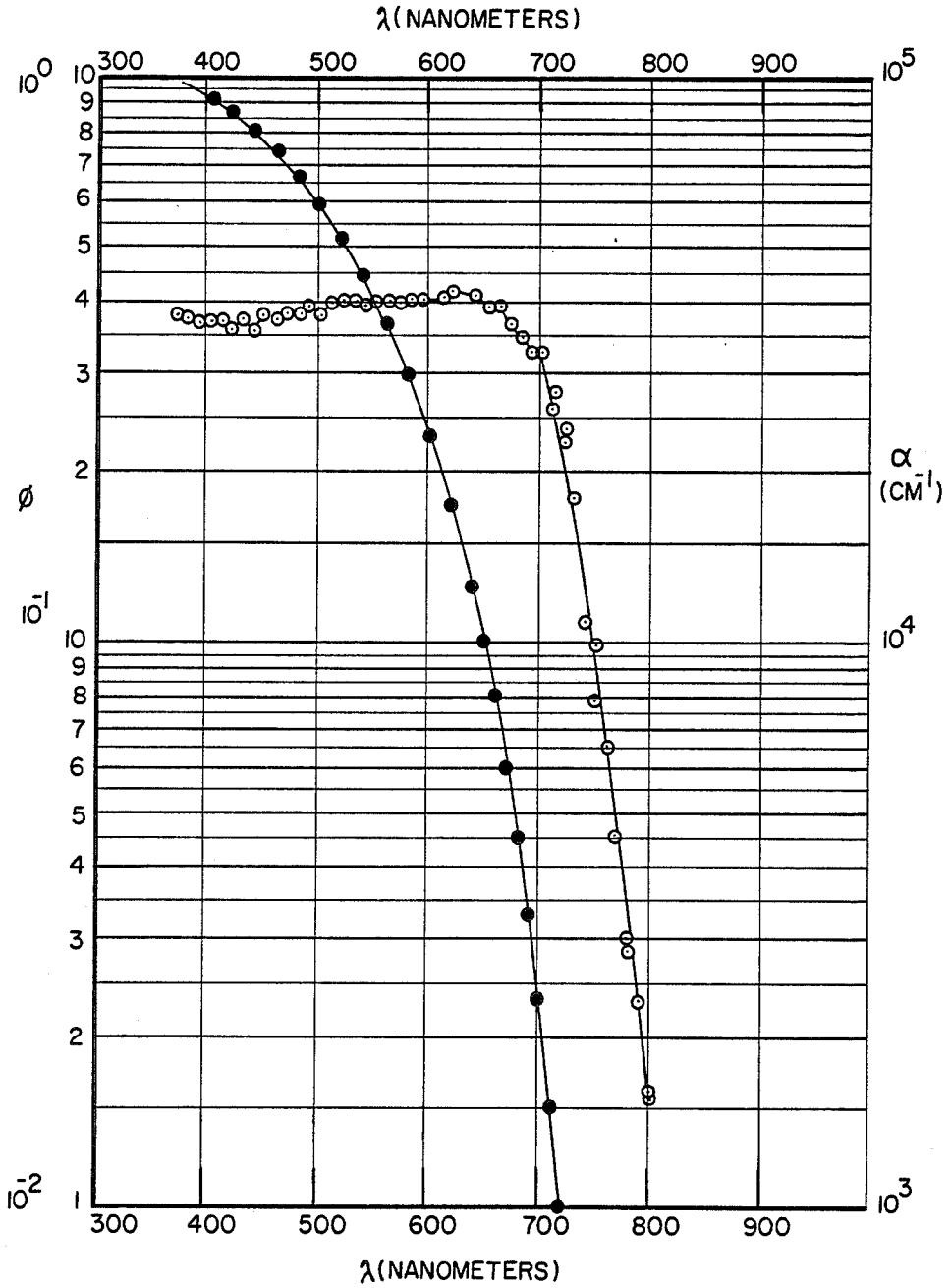
FIG. 1 illustrates the absorption spectrum and the spectral dependence of the quantum efficiency of an α-Si(H) photoreceptor.

The multi-layer photoconductive elements with which this invention is concerned comprise an electrically-conductive support and at least one α-Si(H) layer. The elements can include doped and/or intrinsic α-Si(H) layers and can also include one or more barrier layers. Such elements are well known in the prior art and it is the novel combination of such elements with both a sensitizing layer and a supersensitizing layer having the characteristics described herein that constitutes the present invention.

The support can be either an electrically-conductive material or a composite material comprised of an electrically-insulating substrate coated with one or more conductive layers. The electrically-conductive support should be a relatively rigid material and preferably one that has a thermal expansion coefficient that is fairly close to that of α-Si(H). Particularly useful materials include aluminum and glass that has been coated with a suitable conductive coating. For electrophotographic use, the support is preferably fabricated in a drum configuration, since such configuration is most appropriate for use with a relatively hard material such as α-Si(H).

Intrinsic α-Si(H) can be formed by processes which are well known in the art. Most commonly, the process employed is a gas phase reaction, known as plasma-induced dissociation, using a silane (for example $SiH_4$) as the starting material. The hydrogen content of the intrinsic α-Si(H) layer can be varied over a broad range to provide particular characteristics as desired. Generally, the hydrogen content is in the range of 1 to 50 percent and preferably in the range of 5 to 25 percent (the content of hydrogen being defined in atomic percentage).

A layer of doped α-Si(H) can be formed in the same manner as intrinsic α-Si(H), except that one or more doping elements are utilized in the layer-forming process in an amount sufficient to render the layer n-type or p-type. (Doping elements can also be used in the formation of the intrinsic layer since hydrogenated amorphous silicon, as typically prepared by the plasma-induced dissociation of $SiH_4$, is slightly n-type and a slight degree of p-doping is typically employed to render it intrinsic.) The hydrogen concentration in a doped layer can be in the same general range as in an instrinsic layer.

For electrophotographic applications, a particularly important feature of photoconductive insulating elements comprised of amorphous silicon is the presence of a barrier layer. It serves to prevent the injection of charge carriers from the substrate into the photoconductive layers. Specifically, it prevents the injection of holes from the substrate when the photoreceptor is charged to a negative potential, and it prevents the injection of electrons from the substrate when the photoreceptor is charged to a positive potential. Either positive or negative charging can be used in electrophotographic processes. Inclusion of a barrier layer in the element is necessary in order for the element to provide adequate charge acceptance.

A number of materials are known to form useful barrier layers to amorphous silicon, for example, oxides such as silicon oxide (SiO) or aluminum oxide ($Al_2O_3$). Preferably, the barrier layer is a layer of α-Si(H) which has been heavily doped with a suitable doping agent. The term "heavily doped", as used herein, is intended to mean a concentration of doping agent of at least 100 ppm.

Many different doping agents are known in the art to be of utility in advantageously modifying the characteristics of α-Si(H). Included among such doping agents are the elements of Group VA of the Periodic Table, namely N, P, As, Sb and Bi, which provide an n-type layer—that is, one which exhibits a preference for conduction of negative charge carriers (electrons)—and the elements of Group IIIA of the Periodic Table, namely B, Al, Ga, In and Tl, which provide a p-type layer—that is one which exhibits a preference for conduction of positive charge carriers (holes). The preferred doping agent for forming an n-type layer is phosphorus, and it is conveniently utilized in the plasma-induced dissociation in the form of phosphine gas ($PH_3$). The preferred doping agent for forming a p-type layer is boron, and it is conveniently utilized in the plasma-induced dissociation in the form of diborane gas ($B_2H_6$).

The concentration of doping agent incorporated in a doped α-Si(H) layer is dependent upon the intended function of the layer. For example, a doped α-Si(H) layer intended to function as a charge-generation layer typically has a moderate concentration, such as 50 ppm, while a doped α-Si(H) layer intended to function as a barrier layer is typically a layer which has been heavily doped, for example, a concentration of 500 ppm.

Unless otherwise specified, the term "a layer of hydrogenated amorphous silicon" is intended, as used herein, to encompass layers which are undoped and layers which are doped with any doping agent in any amount.

As explained hereinabove, the multi-layer photoconductive elements of this invention include both sensitizing and supersensitizing layers. The sensitizing layer comprises a phthalocyanine which serves to spectrally sensitize the hydrogenated amorphous silicon layer by charge injection. The supersensitizing layer comprises an arylamine which functions as a chemical sensitizing agent that serves to assist in the charge injection process. Thus, the sensitizing and supersensitizing layers function together to provide the desired bathochromic shift.

Applicant does not wish to be bound by any theoretical explanation of the manner in which his invention functions. However, the mechanism of its operation is believed to be as hereinafter described.

In the sensitizing layer, the absorption of a photon creates a bound electron-hole pair which is referred to herein as an "exciton". As is known in the art, an exciton is able to dissociate at either a free surface or at some internal dissociation center such as an impurity or stacking fault. In the photoconductive elements of this invention, the exciton diffuses to the interface between the sensitizing layer and the supersensitizing layer where it reacts with the chemical sensitizing agent to dissociate into a free electron and a free hole. Depending on the polarity of the electric field to which the photoconductive element has been subjected, the electron or hole is displaced to the interface between the supersensitizing layer and the hydrogenated amorphous silicon layer and injected into the hydrogenated amorphous silicon layer where it is subject to the same transport processes as holes or electrons that are created in-situ in the hydrogenated amorphous silicon layer.

In the photoconductive elements of this invention, the chemical sensitizing agent serves only to dissociate the exciton; it does not contribute significantly to the absorption process. Thus, the shift in sensitivity contributed by the conjoint action of the sensitizing and supersensitizing layers is determined by the absorption characteristics of the sensitizing layer. Accordingly, the sensitizing layer must be a layer which exhibits a level of absorption in a particular region of the spectrum which differs significantly from the absorption level exhibited by the layer of hydrogenated amorphous silicon in the same region. Thus, to achieve a bathochromic shift to the near infrared, the sensitizing layer must have significantly greater absorption in the near infrared region than does the hydrogenated amorphous silicon layer. Moreover, to function effectively, the sensitizing layer must exhibit a relatively high photogeneration efficiency in the region of the spectrum in which the hydrogenated amorphous silicon layer exhibits maximum absorption. The phthalocyanines possess all of these necessary characteristics, and thus are especially well suited for use in the present invention.

The photogeneration efficiency is defined as the ratio of the number of free electron hole pairs created to the incident photon flux. In the region of peak absorption, the photogeneration efficiency of α-Si(H) approaches unity.

The photoreceptor properties that determine the radiation necessary to form the electrostatic latent image are the quantum efficiency, thickness, dielectric constant, and trapping. In the case of capacitive charging, and in the absence of trapping and/or recombination, the exposure can be expressed as:

$$E = \frac{\epsilon k}{Le\lambda}\left(\frac{\Delta V}{\phi}\right)$$

where E is the exposure in ergs/cm$^2$, $\epsilon$ the relative dielectric constant, L the thickness in cm, e the electronic charge in esu, $\lambda$ the wavelength in nm, $\phi$ the quantum efficiency, k a constant equal to $5.2\times10^{-13}$, and $\Delta V$ the voltage difference between the image and background area, $V_i - V_b$. The quantum efficiency is defined as the ratio of the decrease in the surface charge density to the incident photon flux, assuming the surface charge density is related to the voltage by the geometrical capacitance. Defined in this manner, the maximum quantum efficiency is unity.

In order to perform its function of aiding in the dissociation of excitons photogenerated by the sensitizing layer, the supersensitizing layer must be interposed between and in contact with both the layer of hydrogenated amorphous silicon and the sensitizing layer.

As hereinbefore described, in the present invention the sensitizing layer contains a phthalocyanine which serves as a spectral sensitizing agent and the supersensitizing layer contains an arylamine which serves as a chemical sensitizing agent.

Phthalocyanines and their use in electrophotography are very well known. Typical examples of the phthalocyanines which can be used in this invention are described in Carreira et al, U.S. Pat. No. 3,615,558, issued Oct. 26, 1971; Griffiths et al, U.S. Pat. No. 3,903,107 issued Sept. 2, 1975; and Ueda, U.S. Pat. No. 4,547,447, issued Oct. 15, 1985. Particularly useful phthalocyanines for used in this invention are the indium phthalocyanines. The peak absorption of the indium phthalocyanines is in the range of 730 to 780 nm, depending on whether the material is amorphous or crystalline. For other phthalocyanines, the peak absorption is shifted to slightly shorter wavelengths. The photogeneration efficiencies of the indium phthalocyanines are comparable to those of α-Si(H) which also makes them especially useful in this invention.

Most preferred for use as spectral sensitizing agents in the photoconductive elements of this invention are the β-phase indium phthalocyanines described in Borsenberger et al, U.S. Pat. No. 4,471,039, issued Sept. 11, 1984, the disclosure of which is incorporated herein by reference.

Materials useful as chemical sensitizing agents in the photoconductive elements of this invention are the arylamines. These are materials which are typically employed in multi-active photoconductive insulating elements as charge transport agents. They have been found to be highly effective in assisting in the charge injection process in the photoconductive elements described herein. Useful arylamines include monoarylamines, diarylamines and triarylamines as well as polymeric arylamines. Included among the many patents describing the use of arylamines as photoconductors are Klupfel et al, U.S. Pat. No. 3,180,730, issued Apr. 27, 1965; Fox, U.S. Pat. No. 3,240,597, issued Mar. 15, 1966; Brantly et al, U.S. Pat. No. 3,567,450, issued Mar. 2, 1971; and Brantly et al, U.S. Pat. No. 3,658,520, issued Apr. 25, 1972.

Particularly preferred arylamines for the purposes of this invention are those of the formula:

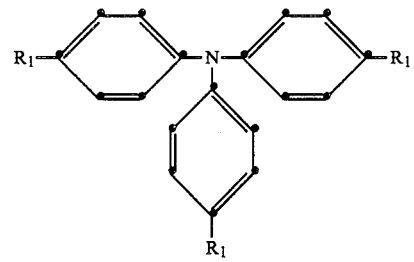

where $R_1$ is hydrogen or alkyl of 1 to 4 carbon atoms, and those of the formula:

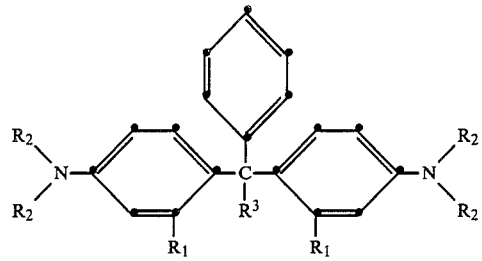

where $R_1$ is hydrogen or alkyl of 1 to 4 carbon atoms, $R_2$ is alkyl of 1 to 4 carbon atoms, and $R_3$ is hydrogen, alkyl of 1 to 4 carbon atoms or phenyl.

Specific illustrative examples of the particularly preferred arylamines include:

tri-p-tolylamine
1,1-bis(4-di-p-tolylaminophenyl)cyclohexane
1,1-bis(4-di-p-tolylaminophenyl)-4-methyl-cyclohexane
4,4'-benzylidene bis(N,N'-diethyl-m-toludine)
bis(4-diethylamino)tetraphenylmethane
1,1-bis(4-[di-4-tolylamino]phenyl)-3-phenylpropane
1,1-bis(4-[di-4-tolylamino]phenyl)-2-phenylethane
1,1-bis(4-[di-4-tolylamino]phenyl)-2-phenylpropane
1,1-bis(4-[di-4-tolylamino]phenyl-3-phenyl-2-propane
bis(4-[di-4-tolylamino]phenyl)phenylmethane
1,1-bis(4-[di-4-tolylamino]-2-methylphenyl-3-phenylpropane
1,1-bis(4-[di-4-tolylamino]phenyl)propane
2,2-bis(4-[di-4-tolylamino]phenyl)butane
1,1-bis(4-[di-4-tolylamino]phenyl)heptane
2,2-bis(4-[di-4-tolylamino]phenyl)-5-(4-nitrobenzoxy)-pentane
and the like.

In the photoconductive elements of this invention, the sensitizing layer is typically the outermost layer, i.e., the layer furthest from the support. However, the order of the layers is not critical. The essential requirements are that the activating radiation be incident upon the sensitizing layer, and that the supersensitizing layer be in contact on one side with the sensitizing layer and on its other side with an α-Si(H) layer. Thus, while the layer arrangement is typically support, then α-Si(H)

layer, then super-sensitizing layer and then sensitizing layer and the exposure is from the front side; it is also feasible for the layer arrangement to be support, then sensitizing layer, then supersensitizing layer, and then α-Si(H) layer, provided that exposure is then from the back side, i.e., the exposure is through the support. The latter arrangement, of course, requires a support that permits adequate transmittance of the activating radiation.

The thickness of the various layers making up the photoconductive elements of this invention can be varied widely. Generally speaking, each α-Si(H) layer, other than a barrier layer, will have a thickness of from about 1 to about 100 microns, more typically from about 10 to about 50 microns. When a barrier layer is employed, it will typically have a thickness in the range of from about 0.01 to about 2 microns. The sensitizing layer must be sufficiently thick to absorb the activating radiation. Typically, a thickness in the range of from about 0.1 to about 2 microns, and more preferably in the range of from about 0.2 to about 0.5 microns, is suitable. The supersensitizing layer typically has a thickness in the range of from about 0.01 to about 0.2 microns, and more preferably in the range of from about 0.03 to about 0.1 microns.

In addition to the essential layers described hereinabove, the photoconductive elements of this invention can contain certain optional layers. For example, they can contain anti-reflection layers to reduce reflection and thereby increase efficiency. Silicon nitride is a particularly useful material for forming an anti-reflection layer, and is advantageously employed at a thickness of about 0.1 to about 0.5 microns.

A wide variety of different processes can be used in preparing the multi-layer photoconductive elements of this invention. Preferably, the α-Si(H) layer is formed by a process of plasma induced dissociation of gaseous silane. Both the sensitizing and supersensitizing layers can be conveniently prepared by a process of thermal sublimation. For optimum results, the phthalocyanine should be converted to a crystalline from using well known techniques such as are described in Borsenberger et al, U.S. Pat. No. 4,471,039, issued Sept. 11, 1984.

The invention is further illustrated by the following examples of its practice.

A α-Si(H) layer having a thickness of 11 microns was deposited on a cylindrical aluminum substrate by the plasma induced dissociation of gaseous silane ($SiH_4$) and doped with 20 ppm of boron. The absorption spectrum and the spectral dependence of the quantum efficiency of this α-Si(H) layer are shown in FIG. 1, with the absorption spectrum being represented by solid circles and the spectral dependence of the quantum efficiency (ϕ) by open circles. From this figure, it is apparent that the photogeneration efficiency decreases sharply with decreasing absorption.

Figure 2:
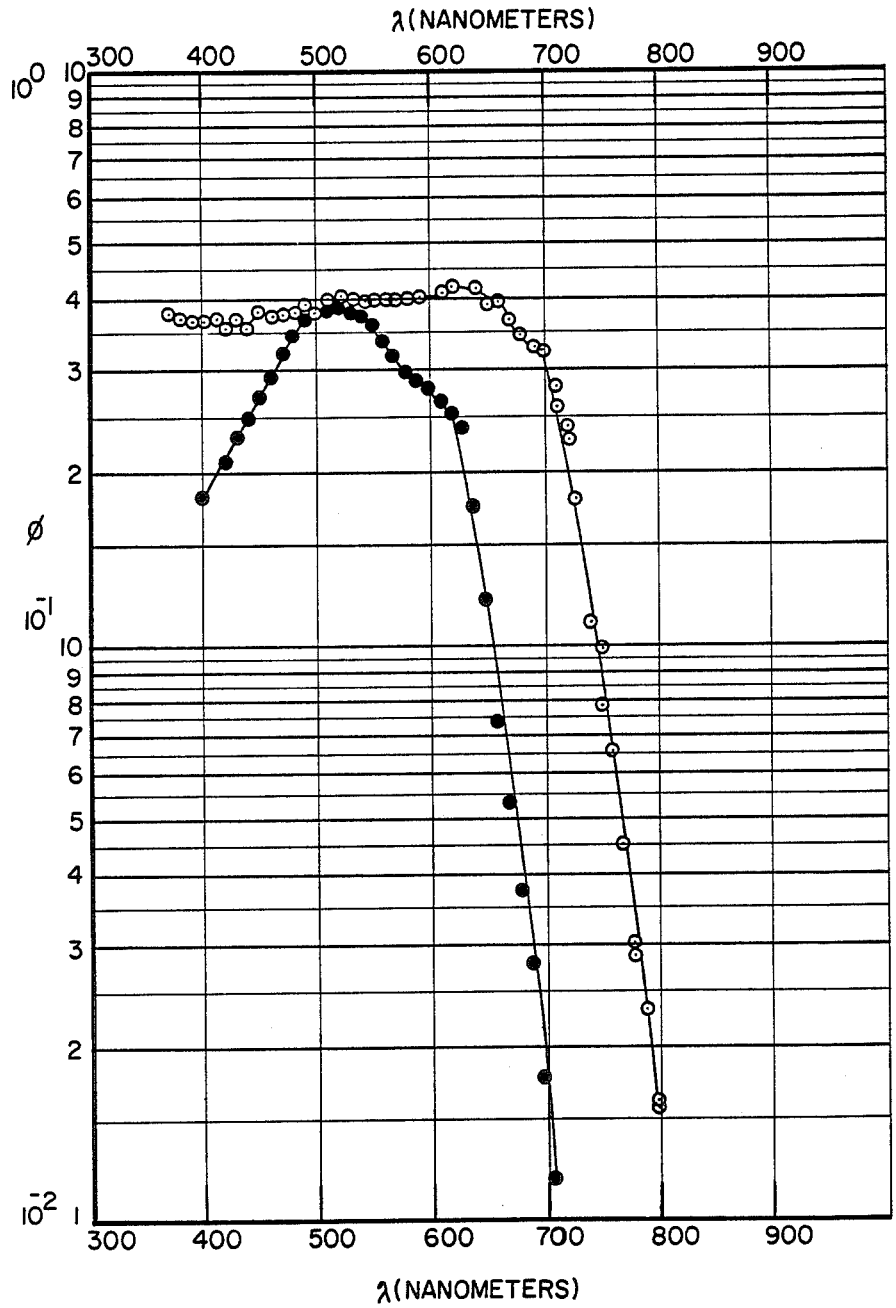
FIG. 2 illustrates the spectral dependence of the quantum efficiency of the α-Si(H) photoreceptor of FIG. 1 and of a similar photoreceptor provided with a sensitizing layer.

FIG. 2 illustrates the quantum efficiency of the 11 micron α-Si(H) layer (open circles) and the quantum efficiency of a photoreceptor comprising a 0.25 micron layer of bromoindium phthalocyanine over the 11 micron α-Si(H) layer (solid circles). The bromoindium phthalocyanine layer was applied by thermal sublimation at a temperature of approximately 380° C. and following its deposition, the photoreceptor was air annealed at a temperature of 200° C. for approximately 5 minutes. From the figure, it is apparent that the layer of bromoindium phthalocyanine did not extend the photosensitivity of the element to longer wavelengths.

Figure 3:
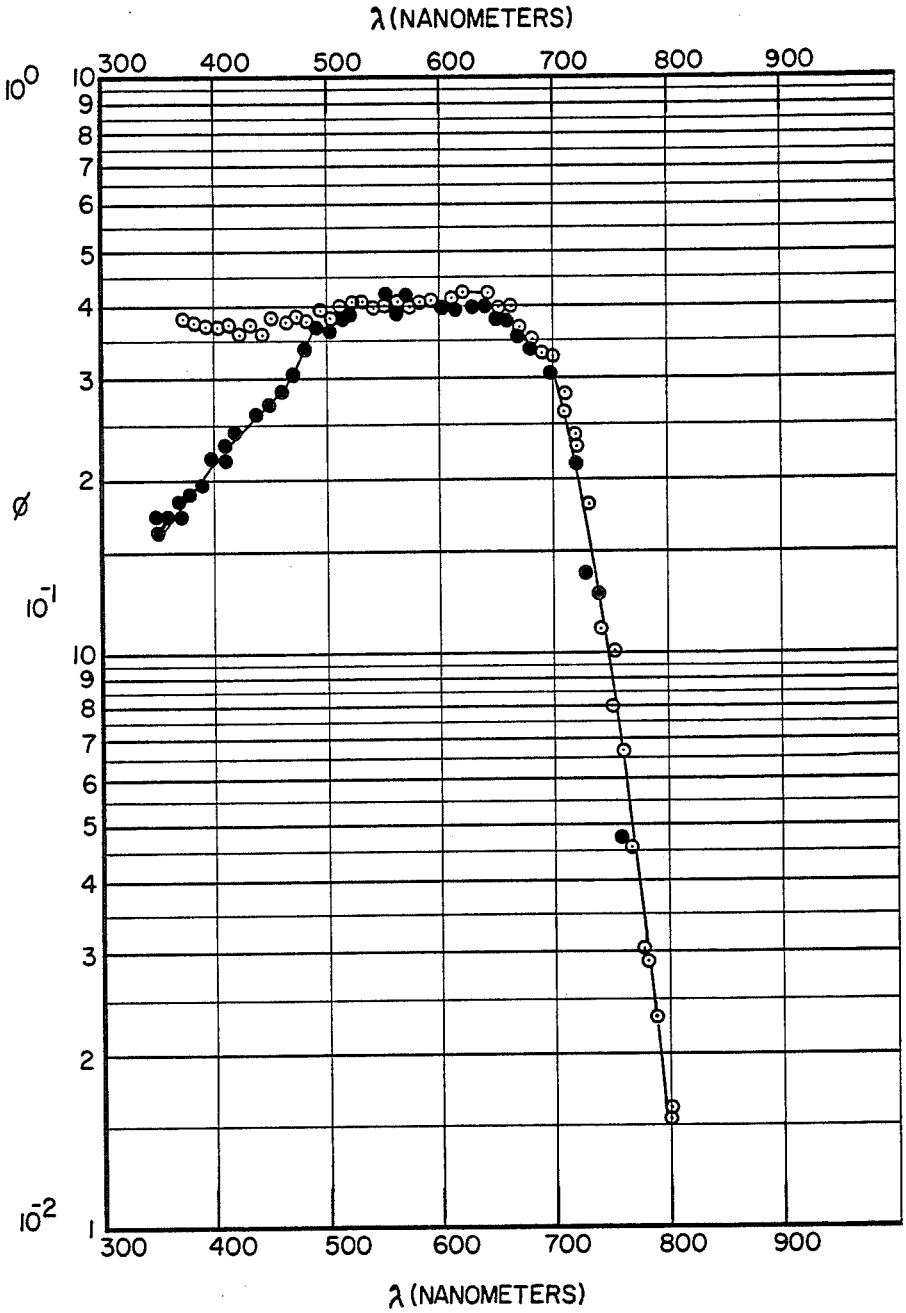
FIG. 3 illustrates the spectral dependence of the quantum efficiency of the α-Si(H) photoreceptor of FIG. 1 and of a similar photoreceptor provided with a supersensitizing layer.

FIG. 3 illustrates the quantum efficiency of the 11 micron α-Si(H) layer (open circles) and the quantum efficiency of a photoreceptor comprising a 0.10 micron layer of 1,1-bis(4-di-p-tolylamino-phenyl)-cyclohexane over the 11 micron α-Si(H) layer (solid circles). The layer of 1,1-bis(4-di-p-tolylaminophenyl) cyclohexane was prepared by thermal sublimation at a temperature of 270° C. As is apparent from FIG. 3, this layer did not extend the photosensitivity to longer wavelengths.

Figure 4:
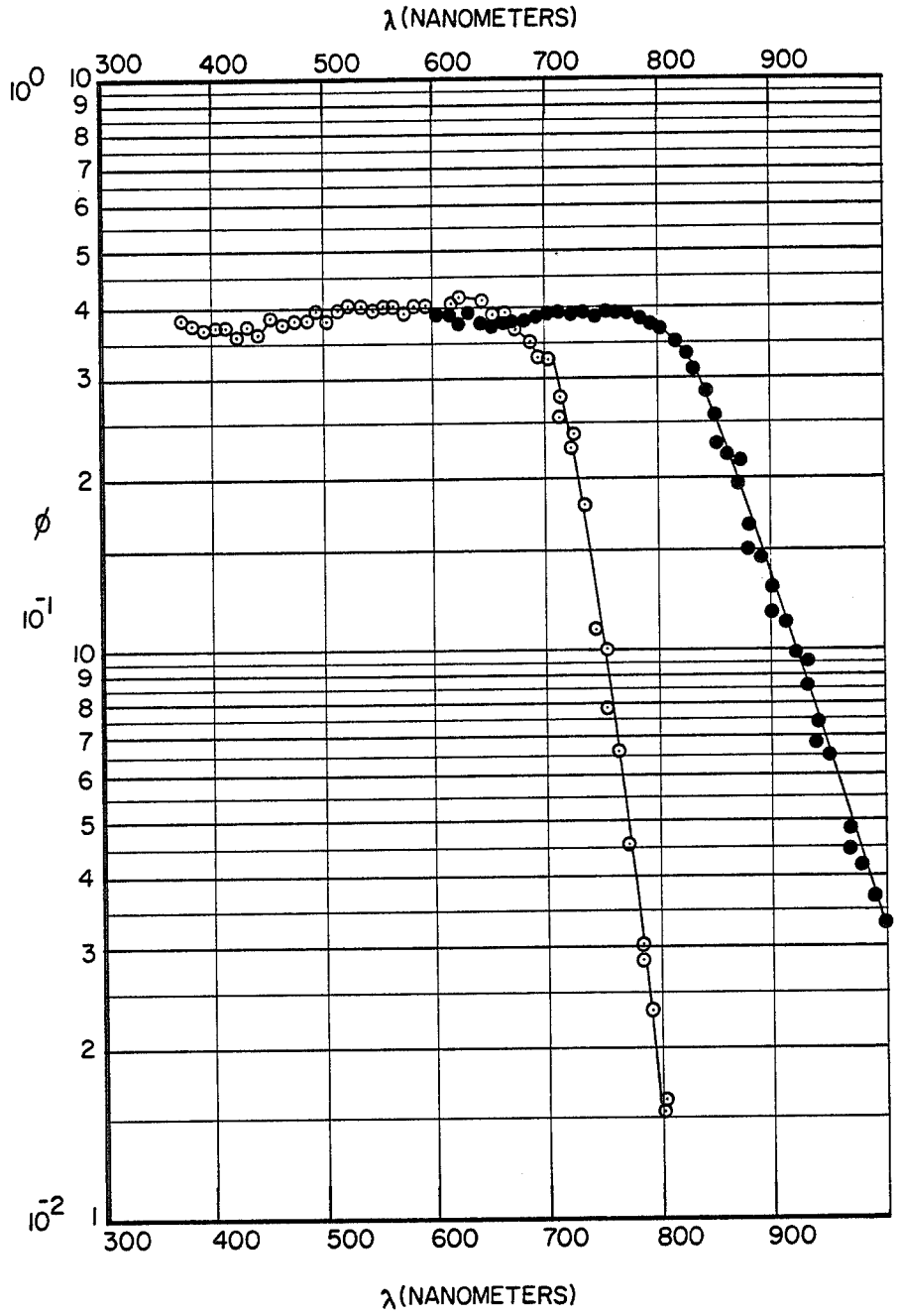
FIG. 4 illustrates the spectral dependence of the quantum efficiency of the α-Si(H) photoreceptor of FIG. 1 and of a similar photoreceptor provided, in accordance with this invention, with both a sensitizing layer and a supersensitizing layer.

FIG. 4 illustrates the quantum efficiency of the 11 micron α-Si(H) layer (open circles) and the quantum efficiency of a photoreceptor comprising a 0.10 micron layer of 1,1-bis(4-di-p-tolylaminophenyl)-cyclohexane over the 11 micron α-Si(H) layer and a 0.25 micron layer of bromoindium phthalocyanine over the 0.10 micron layer of 1,1-bis(4-di-p-tolylaminophenyl) cyclohexane (solid circles). As illustrated by FIG. 4, the effect of providing both a phthalocyanine sensitizing layer and an arylamine supersensitizing layer, in accordance with the present invention, is to extend the long wavelength edge of the action spectrum into the near infrared region of the spectrum. Thus, the combined effect of the sensitizing and supersensitizing layers is to produce a photoconductive element which has a high degree of photosensitivity in both the visible and near infrared regions, whereas this is not achieved by use of either the sensitizing or supersensitizing layer by itself.

In each of FIGS. 1 to 4, measurements of the spectral dependence of the quantum efficiency were carried out by conventional potential discharge techniques. All measurements were made in air with low intensity continuous exposures under emission limited conditions at an electric field of 21 volts/micron. The exposures were incident upon the free surface which was charged to the desired potential by means of a corona discharge. The results reported in FIGS. 1, 2 and 3 are the same with either a positive surface potential or a negative surface potential. However, the result shown in FIG. 4 is obtained only with a positive surface potential. When measured with a negative surface potential, the action spectrum is not shifted to longer wavelengths by the presence of the sensitizing and supersensitizing layers. The fact that the desired shift occurs only with a positive surface potential indicates that charge displacement within the α-Si(H) arises from hole injection from the sensitizing layers.

Similar results were obtained when tri-p-tolylamine was used in place of the 1,1-bis(4-di-p-tolylaminophenyl) cyclohexane. Similar results were also obtained when chloroindium phthalocyanine was used in place of bromoindium phthalocyanine. It was further found that variation in the boron concentration of the α-Si(H) layer over the range of 10 to 50 ppm produced no significant change in the magnitude of the sensitization effect.

The invention has been described in detail with particular reference to preferred embodiments thereof, but it will be understood that variations and modifications can be effected within the spirit and scope of the invention.

I claim:

1. A multi-layer photoconductive element having a high degree of photosensitivity in both the visible and near infrared regions of the spectrum, said element comprising:

a support;

a layer of hydrogenated amorphous silicon;

a sensitizing layer comprising a phthalocyanine that serves as a spectral sensitizing agent;

and a supersensitizing layer comprising an arylamine that serves as a chemical sensitizing agent;

said supersensitizing layer being interposed between and in contact with both said layer of hydrogenated amorphous silicon and said sensitizing layer.

2. A photoconductive element as claimed in claim 1 wherein said hydrogenated amorphous silicon layer-is doped with a sufficient amount of a doping agent to render it n-type or p-type.

3. A photoconductive element as claimed in claim 1 wherein said hydrogenated amorphous silicon layer is doped with an element of Group VA of the Periodic Table.

4. A photoconductive element as claimed in claim 1 wherein said hydrogenated amorphous silicon layer is doped with an element of Group III A of the Periodic Table.

5. A photoconductive element as claimed in claim 1 wherein said hydrogenated amorphous silicon layer is doped with boron.

6. A photoconductive element as claimed in claim 1 comprising a first hydrogenated amorphous silicon layer which serves as a photoconductive layer and a second hydrogenated amorphous silicon layer which serves as a barrier layer.

7. A photoconductive element as claimed in claim 1 wherein said hydrogenated amorphous silicon layer has a thickness in the range of from about 10 to about 50 microns, said sensitizing layer has a thickness in the range of from about 0.1 to about 2 microns, and said supersensitizing layer has a thickness in the range of from about 0.01 to about 0.2 microns.

8. A photoconductive element as claimed in claim 1 wherein said phthalocyanine is an indium phthalocyanine.

9. A photoconductive element as claimed in claim 1 wherein said phthalocyanine is bromoindium phthalocyanine.

10. A photoconductive element as claimed in claim 1 wherein said phthalocyanine is chloroindium phthalocyanine.

11. A photoconductive element as claimed in claim 1 wherein said arylamine is tri-p-tolylamine.

12. A photoconductive element as claimed in claim 1 wherein said arylamine is 1,1-bis(4-di-p-tolylaminophenyl)cyclohexane.

13. A multi-layer photoconductive element having a high degree of photosensitivity in both the visible and near infrared regions of the spectrum, said element comprising:

a support bearing a layer of hydrogenated amorphous silicon;

a supersensitizing layer directly overlying said layer of hydrogenated amorphous silicon, said supersensitizing layer comprising an arylamine that serves as a chemical sensitizing agent, said arylamine having the formula:

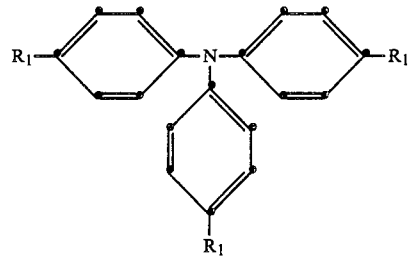

where $R_1$ is hydrogen or alkyl of 1 to 4 carbon atoms, or the formula:

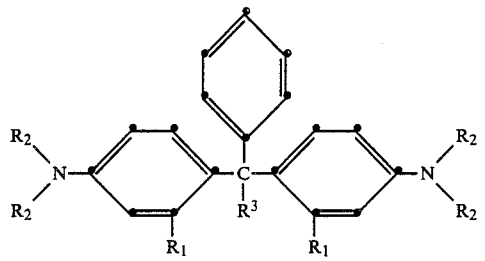

where $R_1$ is hydrogen or alkyl of 1 to 4 carbon atoms, $R_2$ is alkyl of 1 to 4 carbon atoms, and $R_3$ is hydrogen, alkyl of 1 to 4 carbon atoms or phenyl;

and a sensitizing layer directly overlying said supersensitizing layer, said sensitizing layer comprising an indium phthalocyanine that serves as a spectral sensitizing agent.

14. A multi-layer photoconductive element having a high degree of photosensitivity in both the visible and near infrared regions of the spectrum, said element comprising:

a support bearing a layer of boron-doped hydrogenated amorphous silicon having a thickness in the range of from about 10 to about 50 microns;

a supersensitizing layer having a thickness in the range of from about 0.01 to about 0.2 microns directly overlying said layer of boron-doped hydrogenated amorphous silicon, said supersensitizing layer comprising 1,1-bis(4-di-p-tolylaminophenyl)-cyclohexane as a chemical sensitizing agent:

and a sensitizing layer having a thickness in the range of from about 0.1 to about 2 microns directly overlying said supersensitizing layer, said sensitizing layer comprising bromoindium phthalocyanine as a spectral sensitizing agent.

* * * * *